US006443129B1

(12) United States Patent
Boecking

(10) Patent No.: US 6,443,129 B1
(45) Date of Patent: Sep. 3, 2002

(54) PRESSURE BOOSTER FOR A FUEL INJECTION SYSTEM FOR INTERNAL COMBUSTION ENGINES, WITH HYDRAULICALLY REINFORCED REFILLING

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/868,049

(22) PCT Filed: Sep. 28, 2000

(86) PCT No.: PCT/DE00/03386

§ 371 (c)(1),
(2), (4) Date: Sep. 5, 2001

(87) PCT Pub. No.: WO01/27466

PCT Pub. Date: Apr. 19, 2001

(30) Foreign Application Priority Data

Oct. 14, 1999 (DE) ..... 199 49 525

(51) Int. Cl.[7] ..... F02M 37/04
(52) U.S. Cl. ..... 123/446; 123/467
(58) Field of Search ..... 123/446, 447, 123/467; 239/88–96

(56) References Cited

U.S. PATENT DOCUMENTS 5,622,152 A * 4/1997 Ishida ..... 123/446
5,852,997 A * 12/1998 Vanderpoel ..... 123/446

* cited by examiner

*Primary Examiner*—Thomas N. Moulis
(74) *Attorney, Agent, or Firm*—Ronald E. Greigg

(57) ABSTRACT

An injection system for internal combustion engines with a pressure booster is proposed, in which the stepped piston of the pressure booster is moved back to its outset position by a pressure surge. At the same time, the second pressure chamber or the injection nozzle is refilled from the leaking oil return.

19 Claims, 1 Drawing Sheet

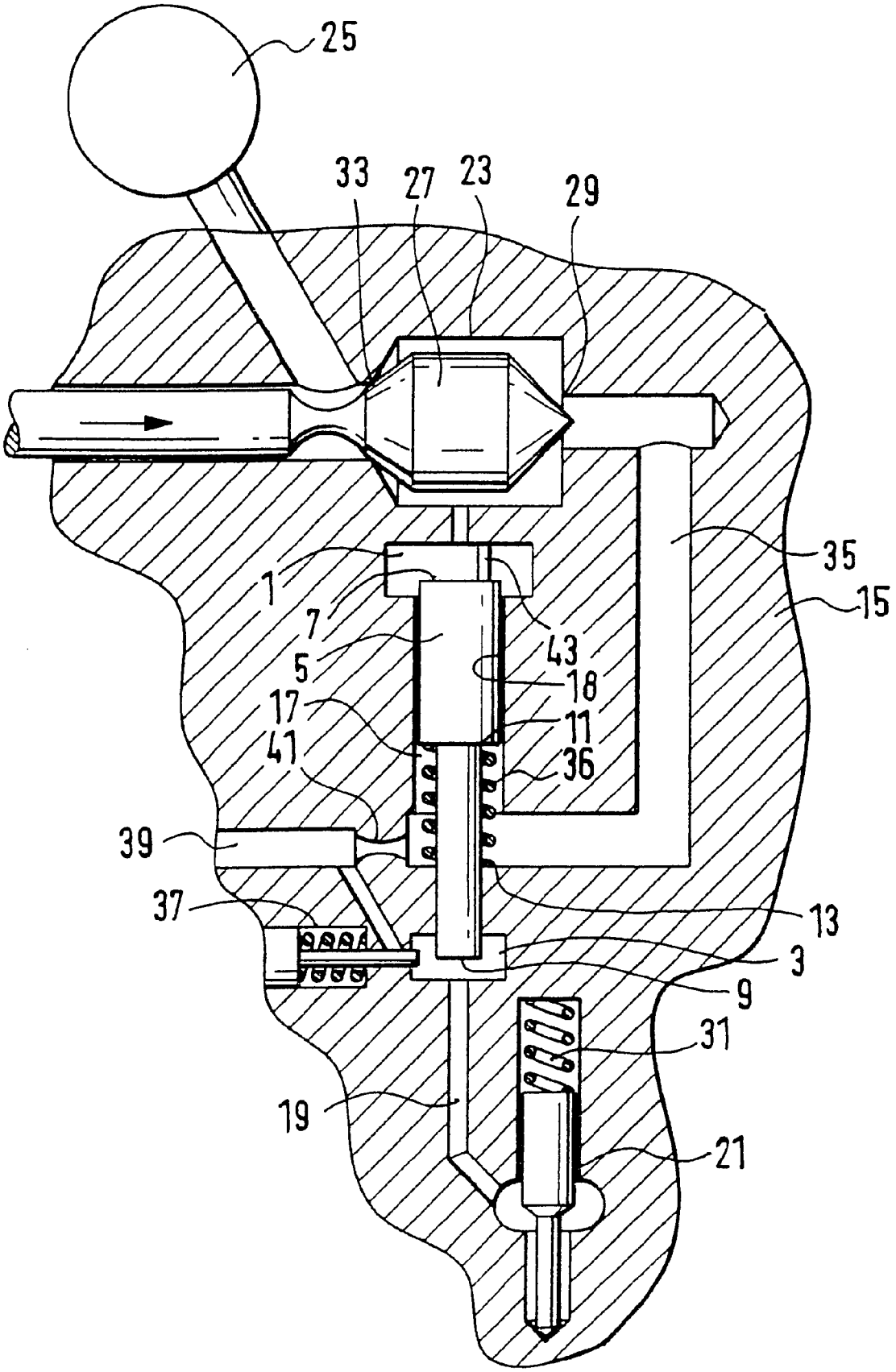
25
33
27
23
29
35
15
1
7
43
5
18
17
11
41
36
39
37
13
3
9
31
19
21

PRESSURE BOOSTER FOR A FUEL INJECTION SYSTEM FOR INTERNAL COMBUSTION ENGINES, WITH HYDRAULICALLY REINFORCED REFILLING

CROSS-REFERENCE TO RELATED APPLICATIONS

This application is 35 USC 371 application of PCT/DE 00/03386 filed on Sep. 28, 2000.

BACKGROUND OF THE INVENTION

1. Field of the Invention

The invention is based on a pressure booster for a fuel injection system for internal combustion engines; the pressure booster has a stepped piston which is displaceable in a bore and whose end faces each define one pressure chamber, and a first, larger end face of the stepped piston defines a first pressure chamber, which can be made to communicate with a high-pressure reservoir, and a second, opposed, smaller end face of the stepped piston defines a second pressure chamber, communicating with an injection nozzle; and the cross-sectional change of the stepped piston and a shoulder in a housing of the pressure booster define a relief chamber.

2. Description of the Prior Art

In such pressure boosters, refilling of the second pressure chamber and of the injection nozzle has been done in the past by a restoring spring acting on the stepped piston. A disadvantage of this prior art version is that the restoring spring must have a high spring rate, in order to enable the refilling in a sufficiently short time between injections. The result is large dimensions of the restoring spring. In some pressure boosters, especially those with a low boosting ratio, the requisite installation space for such a restoring spring is often unavailable.

SUMMARY AND OBJECTS OF THE INVENTION

It is the primary object of the invention to furnish a pressure booster whose demand for space for the means for refilling the pressure booster are low and which is simple in construction.

According to the invention, this object is attained by a pressure booster for a fuel injection system for internal combustion engines, in which the pressure booster has a stepped piston which is displaceable in a bore and whose end faces each define one pressure chamber; in which a first, larger end face of the stepped piston defines a first pressure chamber, which can be made to communicate with a high-pressure reservoir, and a second, opposed, smaller end face of the stepped piston defines a second pressure chamber, communicating with an injection nozzle; in which the cross-sectional change of the stepped piston and a shoulder in a housing of the pressure booster define a relief chamber; and in which the first pressure chamber and the relief chamber can be made to communicate hydraulically with one another.

This pressure booster according to the invention has the advantage that the pressure present in the first pressure chamber after the termination of the injection can be utilized to generate a hydraulic force, acting on the cross-sectional change of the stepped piston in the relief chamber, that returns the stepped piston to its outset position before the onset of the injection. At the same time, the pressure in the second pressure chamber of the pressure booster collapses, so that the injection is ended. As a result, the refilling of the second pressure chamber in the injection nozzle is made possible or is facilitated substantially. Furthermore, because it is possible to dispense with a large-sized restoring spring, the relief chamber can be kept small, which is necessary especially in pressure boosters with a low boosting ratio.

A variant of the invention provides that between the high-pressure reservoir, first pressure chamber and relief chamber, a control valve, in particular a 3/2-way control valve, is disposed, which hydraulically disconnects the high-pressure reservoir from the relief chamber or the high-pressure reservoir from the relief chamber and the first pressure chamber, so that all the functions of the pressure booster can be controlled simply and reliably.

One version of the invention provides that the control valve is actuated by a piezoelectric actuator or an electromagnet, so that depending on the operating conditions and the requisite control forces, a suitable actuator can be employed.

In one feature of the invention, a restoring spring is fastened into the relief chamber and is braced on a stationary support and in the process urges the stepped piston, at its cross-sectional change toward the relief chamber, counter to its pumping direction, so that the refilling of the pressure booster of the invention is reinforced by the restoring spring, and the best possible utilization is made of the existing relief chamber. Furthermore, the restoring spring has the task, if pressure is absent in the high-pressure reservoir of the fuel injection system, for example because the engine has been shut off, of moving the stepped piston into its outset position.

In a further embodiment of the invention, a leaking oil return of the pressure booster feeds fuel to the injection nozzle via a check valve, so that as soon as the pressure in the second pressure chamber drops below the pressure of the leaking oil return, the pressure booster is refilled without additional pumping means. The check valve prevents the return flow of fuel from the second pressure chamber or from the injection nozzle into the leaking oil return.

In another feature of the invention, the check valve discharges into the second pressure chamber, so that the fuel in the high-pressure region of the fuel injection system is exchanged continuously, namely from the second pressure chamber via a high-pressure path and to the injection nozzle. As a result, the fuel in the high-pressure region remains relatively cool, which improves the operating performance of the fuel injection system.

In a further feature of the invention, the check valve is spring-loaded, so that a more-stable operating performance of the check valve is achieved.

Another variant provides a stroke stop, which limits the motion of the stepped piston into the first pressure chamber, so that the first pressure chamber always has a certain minimum volume and thus a certain "softness". This reduces force peaks and lessens the load on the individual components.

In another version it is provided that the stroke stop is disposed in the first pressure chamber, resulting in a simple, compact design, and furthermore the stroke stop transmits essentially only forces in the axial direction of the stepped piston to this stepped piston.

BRIEF DESCRIPTION OF THE DRAWINGS

Further objects and advantages of the invention will be apparent from the detailed description contained herein below, taken in conjunction with the single FIGURE of the drawing which is a fragmentary sectional view of the pressure booster of the invention.

DESCRIPTION OF THE PREFERRED EMBODIMENTS

A pressure booster of the invention is shown in the drawing. The central components of the pressure booster are the first pressure chamber 1 and the second pressure chamber 3. A stepped piston 5 is disposed between the two pressure chambers 1 and 3. The first end face 7 protruding into the first pressure chamber 1 is larger than the second end face 9 protruding into the second pressure chamber. The ratio of the first end face 7 to the second end face 9 determines the pressure boosting ratio of the pressure booster. A cross-sectional change 11 and a shoulder 13 of a housing 15 of the pressure booster define a relief chamber 17. The stepped piston 5 is guided in a bore 18 of the housing 15.

The second pressure chamber 3 communicates with an injection nozzle 21 via a high-pressure path 19. A control valve 23 controls the delivery of fuel from a high-pressure reservoir 25 into the first pressure chamber 1 and into the relief chamber 17. The control valve 23 is embodied as a 3/2-way control valve. One connection is to the high-pressure reservoir 25, a second connection connects the control valve 23 with the first pressure chamber 1, and a third connection of the control valve 23 leads to the relief chamber 17. The control valve 23 is controlled via a control piston 27, which is moved back and forth between its switching positions by an actuator, not shown, such as a piezoelectric actuator or an electromagnet.

When the control piston 27 is seated on a first sealing seat 29, hydraulic communication exists between the high-pressure reservoir 25 and the control chamber 1. The stepped piston 5 begins to move in the direction of the second pressure chamber 3 and in the process generates a higher pressure, corresponding to the boosting ratio, in this pressure chamber compared to that in the first pressure chamber 1. As soon as the pressure in the second pressure chamber 3 and thus also in the injection nozzle 21 is high enough to overcome the closing force of a closing spring 31, the injection nozzle 21 opens, and the injection begins.

When the control piston 27 of the control valve 23 is pressed against a second sealing seat 33, the communication between the high-pressure reservoir 25 and the first pressure chamber 1 is interrupted. Because of the compressibility of the fuel at high pressure that is located in the control valve 23 and the first pressure chamber 1, and because of the elasticity of the housing 15, a pressure surge is created, which via a connecting line 35 reaches the relief chamber 17. The resultant hydraulic force acting on the cross-sectional change 11 moves the stepped piston in the direction of the first pressure chamber. Since this is a highly unsteady process, a purely statistical manner of observation does not apply; it would lead to the finding that the first end face 7 is larger than the cross-sectional change 11 and thus no resultant force can be generated in the direction of the first pressure chamber. A restoring spring 36 serves to reinforce the return motion of the stepped piston 5. It also moves the stepped piston 5 into its outset position when the engine has been shut off.

By the motion of the stepped piston 5 in the direction of the first pressure chamber 1, the pressure in the second pressure chamber 3 collapses, so that the closing spring 31 closes the injection nozzle 21 again, and the injection is thus ended. On the other hand, the collapse of the pressure in the second pressure chamber 3 causes fuel from a leaking oil return 39 to flow into the second pressure chamber 3 via a check valve 37, and the pressure booster or injection nozzle 21 is thus refilled. The leaking oil return 39 is filled, among other ways, by the leakage between the stepped piston 5 and the housing 15 and by the control quantity from the relief chamber 17. To allow an adequate pressure to build up in the relief chamber 17, an outlet throttle 41 is disposed between the relief chamber 17 and the leaking oil return 39.

The check valve 37, in the embodiment shown in the drawing, is spring-loaded. However, this need not necessarily be the case.

The foregoing relates to preferred exemplary embodiments of the invention, it being understood that other variants and embodiments thereof are possible within the spirit and scope of the invention, the latter being defined by the appended claim.

I claim:

1. In a pressure booster for a fuel injection system for internal combustion engines, in which the pressure booster has a stepped piston (5) which is displaceable in a bore (18) and whose end faces (7, 9) each define one pressure chamber (1, 3); in which a first, larger end face (7) of the stepped piston (5) defines a first pressure chamber (1), which can be made to communicate with a high-pressure reservoir (25), and a second, opposed, smaller end face (9) of the stepped piston (5) defines a second pressure chamber (3), communicating with an injection nozzle (21); and in which, in transitioning from the larger end face 7 to the smaller end face 9, a cross-sectional change (11) of the stepped piston (5) is produced, which, in cooperation with a shoulder (13) in a housing (15) of the pressure booster define a relief chamber (17), the improvement wherein the first pressure chamber (1) and the relief chamber (17) can be made to communicate hydraulically with one another, wherein between the high-pressure reservoir (25), first pressure chamber (1) and relief chamber (17), a control valve (23) is disposed, which hydraulically disconnects the high-pressure reservoir (25) from the relief chamber (17) or disconnects both the high-pressure reservoir (25) from the relief chamber (17) and the first pressure chamber (1).

2. The pressure booster of claim 1, wherein the control valve (23) is a 3/2-way valve (23).

3. The pressure booster of claim 1, wherein the control valve (23) is actuated by a piezoelectric actuator or an electromagnet.

4. The pressure booster of claim 1, wherein a restoring spring (36) is fastened into the relief chamber (17) and is braced on a stationary support (13) and in the process urges the stepped piston (5), at its cross-sectional change (11) toward the relief chamber, counter to its pumping direction.

5. In a pressure booster for a fuel injection system for internal combustion engines, in which the pressure booster has a stepped piston (5) which is displaceable in a bore (18) and whose end faces (7, 9) each define one pressure chamber (1, 3); in which a first, larger end face (7) of the stepped piston (5) defines a first pressure chamber (1), which can be made to communicate with a high-pressure reservoir (25), and a second, opposed, smaller end face (9) of the stepped piston (5) defines a second pressure chamber (3), communicating with an injection nozzle (21); and in which, in transitioning from the larger end face 7 to the smaller end face 9, a cross-sectional change (11) of the stepped piston (5) is produced, which, in cooperation with a shoulder (13) in a housing (15) of the pressure booster define a relief chamber (17), the improvement wherein the first pressure chamber (1) and the relief chamber (17) can be made to communicate hydraulically with one another, and wherein a leaking oil return (39) of the pressure booster feeds fuel to the injection nozzle (21) via a check valve (37).

6. The pressure booster of claim 5, wherein the check valve (37) discharges into the second pressure chamber (3).

7. The pressure booster of claim 5, wherein the check valve (37) is spring-loaded.

8. In a pressure booster for a fuel injection system for internal combustion engines, in which the pressure booster has a stepped piston (5) which is displaceable in a bore (18) and whose end faces (7, 9) each define one pressure chamber (1, 3); in which a first, larger end face (7) of the stepped piston (5) defines a first pressure chamber (1), which can be made to communicate with a high-pressure reservoir (25), and a second, opposed, smaller end face (9) of the stepped piston (5) defines a second pressure chamber (3), communicating with an injection nozzle (21); and in which, in transitioning from the larger end face 7 to the smaller end face 9, a cross-sectional change (11) of the stepped piston (5) is produced, which, in cooperation with a shoulder (13) in a housing (15) of the pressure booster define a relief chamber (17), the improvement wherein the first pressure chamber (1) and the relief chamber (17) can be made to communicate hydraulically with one another, and wherein a stroke stop (43) is provided, which limits the motion of the stepped piston (5) into the first pressure chamber (1).

9. The pressure booster of claim 8, wherein the stroke stop (43) is disposed in the first pressure chamber (1).

10. The pressure booster of claim 1, wherein the stepped piston (5) is embodied in two parts.

11. The pressure booster of claim 2, wherein the control valve (23) is actuated by a piezoelectric actuator or an electromagnet.

12. The pressure booster of claim 2, wherein a restoring spring (36) is fastened into the relief chamber (17) and is braced on a stationary support (13) and in the process urges the stepped piston (5), at its cross-sectional change (11) toward the relief chamber, counter to its pumping direction.

13. The pressure booster of claim 3, wherein a restoring spring (36) is fastened into the relief chamber (17) and is braced on a stationary support (13) and in the process urges the stepped piston (5), at its cross-sectional change (11) toward the relief chamber, counter to its pumping direction.

14. The pressure booster of claim 1, wherein a leaking oil return (39) of the pressure booster feeds fuel to the injection nozzle (21) via a check valve (37).

15. The pressure booster of claim 3, wherein a leaking oil return (39) of the pressure booster feeds fuel to the injection nozzle (21) via a check valve (37).

16. The pressure booster of claim 4, wherein a leaking oil return (39) of the pressure booster feeds fuel to the injection nozzle (21) via a check valve (37).

17. The pressure booster of claim 4, wherein the check valve (37) discharges into the second pressure chamber(3).

18. The pressure booster of claim 6, wherein the check valve (37) is spring-loaded.

19. The pressure booster of claim 1, wherein a stroke stop (43) is provided, which limits the motion of the stepped piston (5) into the first pressure chamber (1).

* * * * *